US008851231B1

(12) United States Patent
Murphy

(10) Patent No.: US 8,851,231 B1
(45) Date of Patent: Oct. 7, 2014

(54) LAND VEHICLE EXHAUST NOISE CONTROL APPARATUS

(71) Applicant: Kenneth Murphy, Temecula, CA (US)

(72) Inventor: Kenneth Murphy, Temecula, CA (US)

( * ) Notice: Subject to any disclaimer, the term of this patent is extended or adjusted under 35 U.S.C. 154(b) by 0 days.

(21) Appl. No.: 13/815,733

(22) Filed: Mar. 15, 2013

(51) Int. Cl.
*F01N 1/08* (2006.01)

(52) U.S. Cl.
USPC ..... 181/264; 181/237; 181/254

(58) Field of Classification Search
USPC ..... 181/264, 254, 237
See application file for complete search history.

(56) References Cited

U.S. PATENT DOCUMENTS

| | | | | |
|---|---|---|---|---|
| 2,671,523 | A * | 3/1954 | Walker | 181/264 |
| 2,705,541 | A * | 4/1955 | Finch | 181/243 |
| 4,228,868 | A | 10/1980 | Raczuk | |
| 4,715,472 | A * | 12/1987 | McKee | 181/241 |
| 5,214,254 | A | 5/1993 | Sheehan | |
| 5,739,483 | A | 4/1998 | Yashiro | |
| 5,959,263 | A * | 9/1999 | Foltz, Jr. | 181/254 |
| 6,213,251 | B1 | 4/2001 | Kesselring | |
| 6,220,387 | B1 | 4/2001 | Hoppes | |
| 6,520,285 | B2 | 2/2003 | Tobias | |
| 6,598,390 | B2 | 7/2003 | Chang | |
| 6,915,876 | B2 | 7/2005 | Ciray | |
| 6,941,751 | B2 | 9/2005 | Yamamoto | |
| 7,677,357 | B2 * | 3/2010 | Shimomura | 181/249 |
| 7,896,128 | B2 * | 3/2011 | De Leo et al. | 181/241 |
| 7,938,227 | B2 | 5/2011 | Scheetz | |
| 2002/0148679 | A1 * | 10/2002 | Grandmougin et al. | 181/272 |
| 2004/0050618 | A1 * | 3/2004 | Marocco | 181/248 |
| 2004/0178015 | A1 * | 9/2004 | Wiemeler et al. | 181/237 |
| 2006/0124384 | A1 * | 6/2006 | Tary et al. | 181/243 |

* cited by examiner

*Primary Examiner* — Forrest M Phillips
(74) *Attorney, Agent, or Firm* — Dennis W. Beech

(57) ABSTRACT

A housing with a first end wall and second end wall with a first baffle and second baffle spaced apart and positioned between end walls with a cover attached to form a first chamber, an intermediate chamber and a third chamber. An intake tube is inserted through the first end wall, first baffle and second baffle to terminate at an exit end in the third chamber. An exhaust tube is inserted through the second end wall, second baffle and first baffle to terminate at an intake end in the first chamber. The intake tube and exhaust tube each have openings in an intermediate tube wall. The exhaust tube has openings in a second tube wall portion. There is an intermediate port in the first baffle. A threaded shaft of a valve is threadably engaged in a fitting attached in the second end wall to be positioned opposed the exit end.

9 Claims, 4 Drawing Sheets

LAND VEHICLE EXHAUST NOISE CONTROL APPARATUS

BACKGROUND OF THE INVENTION

This invention relates to apparatus for suppression and control of engine exhaust noise sound levels and engine performance. Such apparatus may be known as mufflers for use on automobiles and other types of vehicles and may have adjustable elements for suppression of various frequency noises during varying engine operating conditions. The new exhaust noise control apparatus has an adjustable control valve positionable in a multi-chamber muffler.

Mufflers, variable resonating chamber devices, and automobile exhaust noise suppressor apparatus may be known for use with internal combustion engines and other types of engines that produce a gas discharge and varying frequency noise sound. The mufflers for use in suppressing noise produced by the exhaust of an engine may have multiple chambers formed in the structure of the muffler by the use of baffles or interior walls that may have ports or openings therein and may have interior pipes or tubes for controlling the flow of the gas. The velocity, frequency and pressure of the exhaust gas may be used to change, suppress and resonate the noise frequency and level prior to the exhaust gas exiting the muffler.

In some types of mufflers with baffles and multiple chambers a baffle may have a port formed therein that has a valve to open and close the port based on the pressure of the gas impinging on the valve. This may change the flow of gas into different chambers that may be resonating chambers or allow the gas to exit the muffler from more than one exhaust pipe. Other types of mufflers with baffles may have a variable resonation chamber valve that is rotatable in and out of a valve seat in a chamber port by operation of a rotatable shaft that the chamber valve is attached to adjacent to an edge or wall portion of the valve that may have mounting arms. These types of valves require mechanisms external to the muffler to allow rotation of the shaft and retaining the shaft in position that may include an arm or extension member. This type of structure may also include use of an actuator device to allow rotation of the shaft. The drawback or problem with these various chamber valve devices is the complex structure subject to damage in land vehicle use or lack of access to the valve position control mechanism for adjustment.

SUMMARY OF THE INVENTION

The present invention is directed to apparatus for engine exhaust noise control. A housing may have a first end wall and a second end wall spaced apart with a first baffle and a second baffle spaced apart and positioned between the end walls with a cover attached to form a first chamber, an intermediate chamber and a third chamber interior to the housing. An intake tube is inserted through ports in the first end wall, first baffle and the second baffle to terminate at an exit end in the third chamber. An exhaust tube is inserted through exit ports in the second end wall, the second baffle and the first baffle to terminate at an intake end in the first chamber. The intake tube and the exhaust tube each have openings positioned in a tube wall portion positioned in the intermediate chamber. The exhaust tube also has openings positioned in a second tube wall portion positioned in the third chamber. There is an intermediate port in the first baffle. A threaded shaft of a valve is threadably engaged in a threaded sleeve fitting that is attached in the second end wall opposed the exit end of the intake tube to position a valve body adjacent the exit end for use in restricting gas flow from the exit end as well as plugging the exit end.

These and other features, aspects and advantages of the present invention will become better understood with reference to the following drawings, description and claims.

DETAILED DESCRIPTION

The following detailed description represents the best currently contemplated modes for carrying out the invention. The description is not to be taken in a limiting sense, but is made merely for the purpose of illustrating the general principles of the invention.

Figure 1:
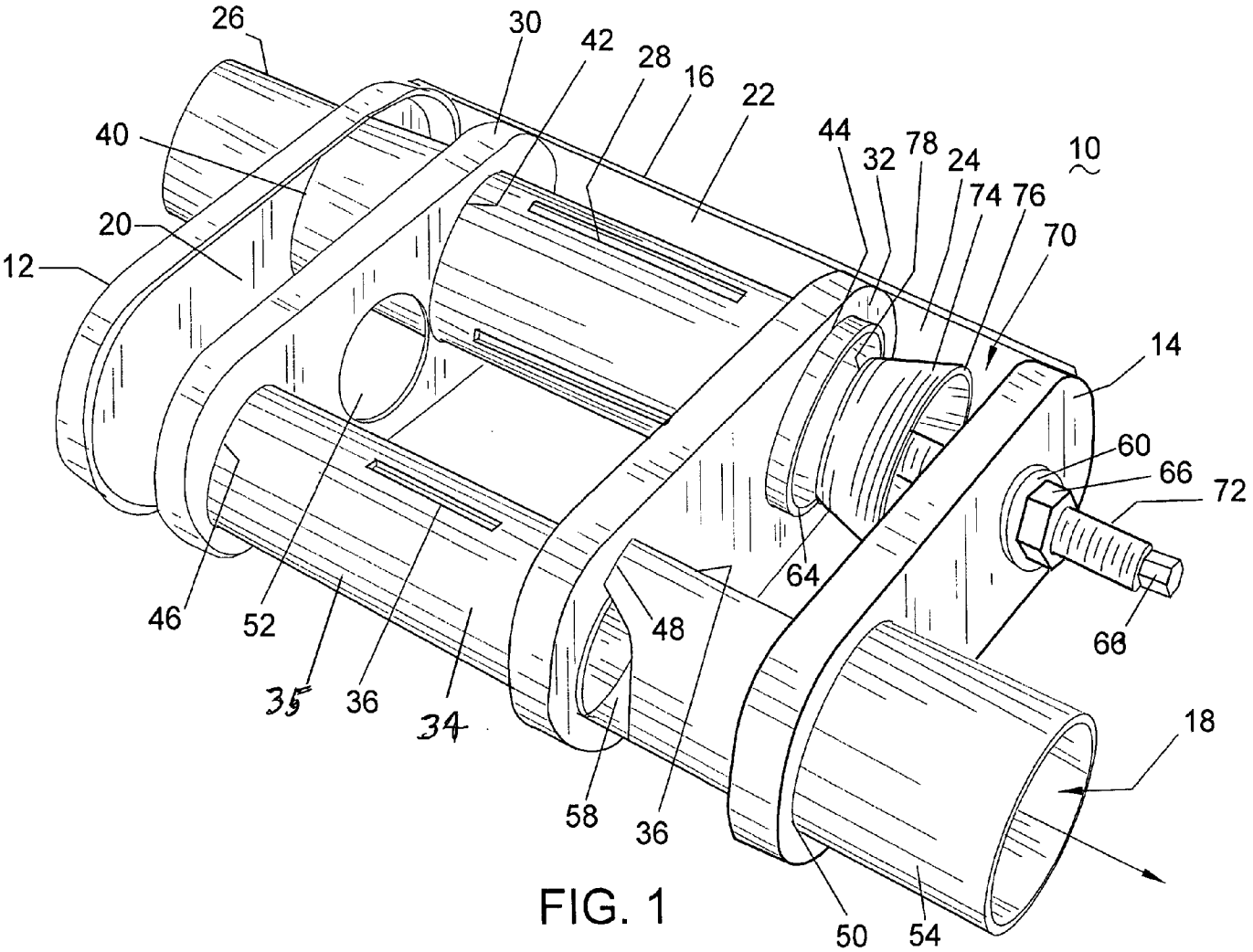
FIG. 1 illustrates a perspective partial cut away view of a muffler with multiple chambers and an adjustable valve according to an embodiment of the invention.
Figure 2:
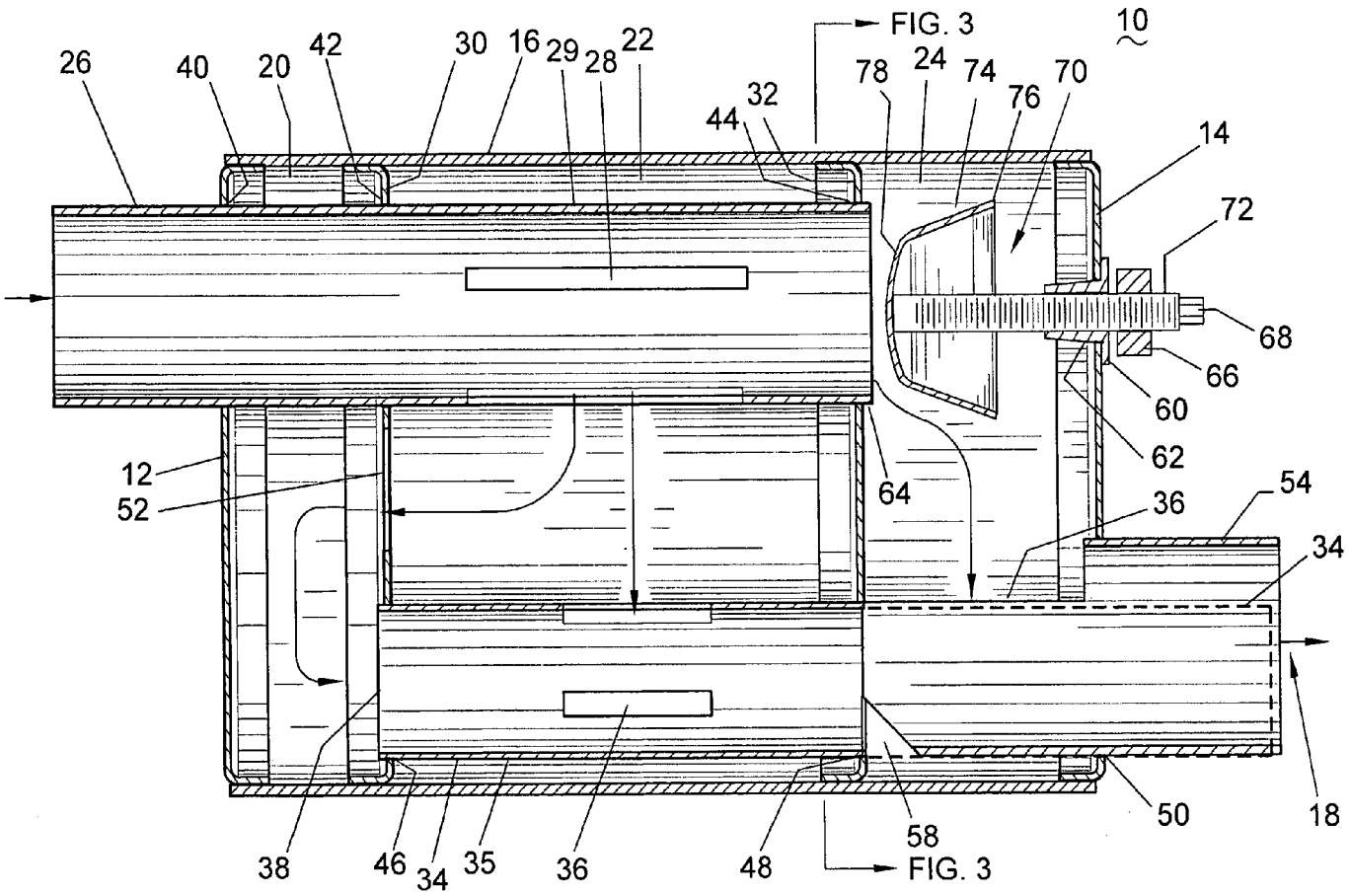
FIG. 2 illustrates a top plan cross-sectional view of a muffler according to an embodiment of the invention.
Figure 3:
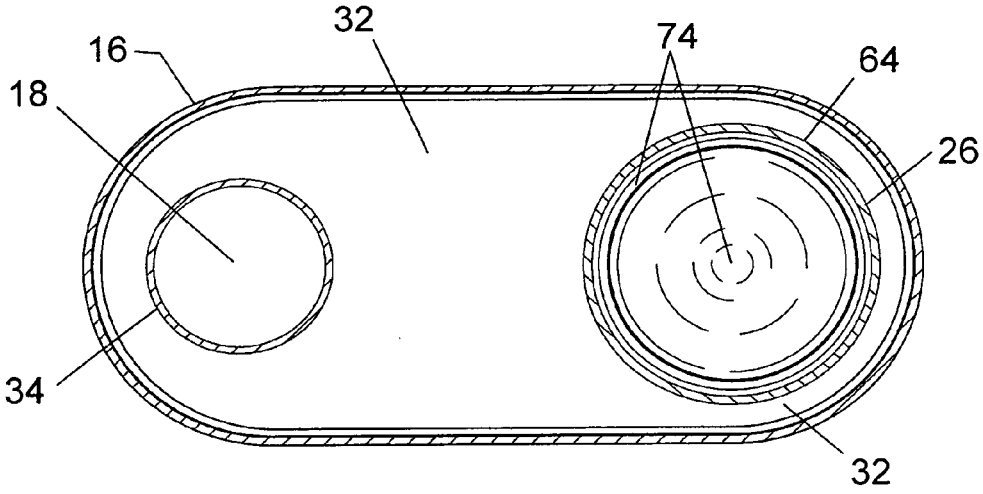
FIG. 3 illustrates a cross-sectional view of a muffler taken along line 3-3 in FIG. 2 according to an embodiment of the invention.

Referring to FIGS. 1 through 3, an exhaust noise control apparatus or muffler 10 may have a first end wall 12 and a second end wall 14 with a cover 16 attached to the walls 12, 14 edges to form a hollow oval or elliptical cross-section housing. There may be a first chamber 20, and intermediate chamber 22 and a third chamber 24 formed in the muffler 10 by a first baffle 30 attached interior to the cover 16 and spaced apart from the first end wall 12 and a second baffle 32 attached interior to the cover 16 in a position intermediate the first baffle 30 and the second end wall 14.

On intake pipe or tube 26 having an inlet end 63 is inserted through an intake port 40 in the first end wall 12, through a first baffle intake port 42 and through a second baffle exhaust port 44 to terminate in the third chamber 24. The intake tube 26 has openings 28 in its wall in the intermediate portion 29 of the tube positioned in the intermediate chamber 22 to allow fluid or gas in the tube 26 to exit into the intermediate chamber 22.

An exhaust tube 34 is inserted in a first baffle exit port 46, in a second baffle unit port 48 and in a second end wall exhaust port 50 to terminate exterior to the muffler 10. The exhaust tube 34 has openings 36 in its wall in the intermediate portion 35 of the tube positioned in the intermediate chamber 22 and in the third chamber 24 to allow gas to enter the tube from either chamber 22, 24. There may be an intermediate port 52 in the first baffle 30 to allow gas in the intermediate chamber 22 to enter the first chamber 20 and thereby enter the intake end 38 of the exhaust tube 34.

The second end wall 14 has a threaded sleeve fitting 60 attached in a hole 62 positioned opposite the exit end 64 of the intake tube 26. A valve 70 with a threaded shaft 72 is threadably positioned in the fitting 60 to allow the valve body 74 to be moved into and out of the exit end 64 of the intake tube 26. The position of the valve body 74 relative to the exit end 64 allows adjusting the sound or noise characteristics of the muffler 10 exhaust output 18. A lock nut 66 may be used to retain the threaded shaft 72 in a desired, tuned position determined by adjustment while running the motor on an automobile or other vehicle.

These adjustments may control sound levels and engine performance. The shaft 72 position and thereby the valve body 74 position may be set for a preferred engine performance and when desired may be adjusted for differing conditions by rotation of the shaft 72. A hexagonal shaft head 68 or bolt head may be used to aid in valve adjustment.

Figure 4:
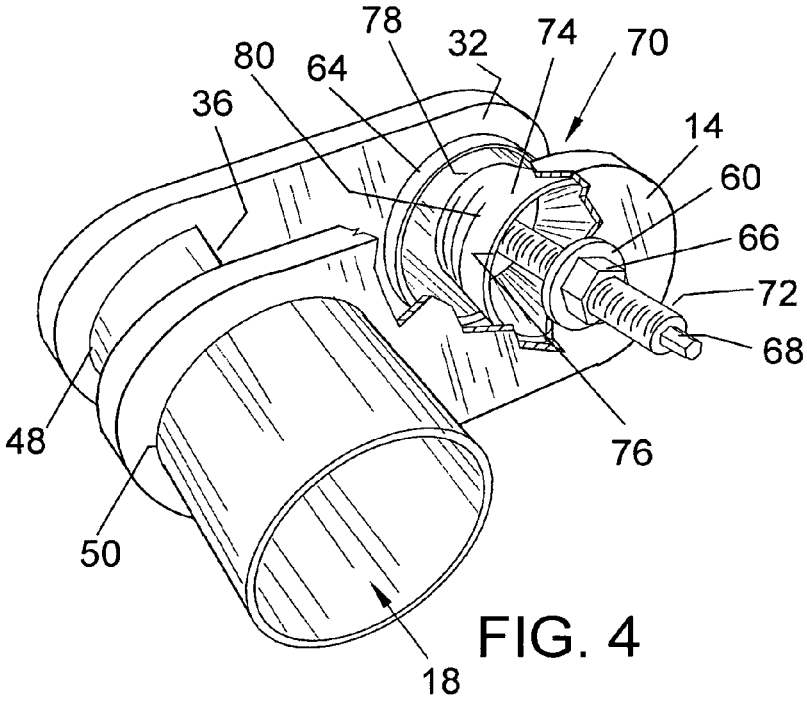
FIG. 4 illustrates a partial sectional perspective view of an adjustable control valve positioned in a muffler end wall relative to a baffle port according to an embodiment of the invention.
Figure 5:
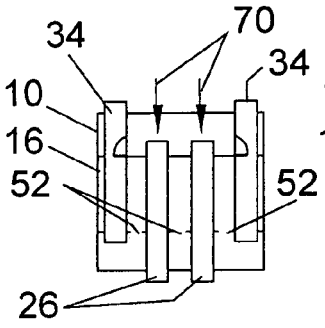
FIGS. 5 through 13 illustrate schematics of various positions and numbers of tubes 26 and 34 in a muffler according to embodiments of the invention.
Figure 6:
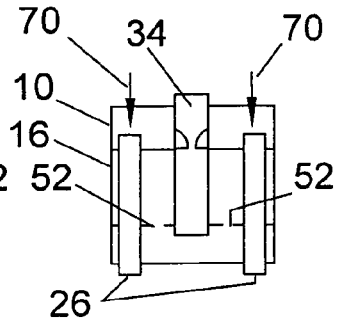
Figure 7:
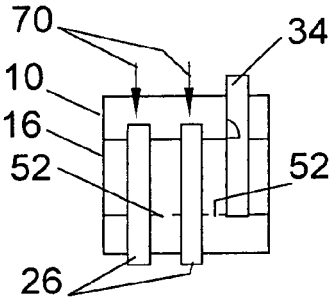
Figure 8:
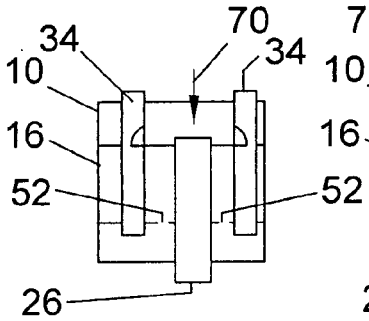
Figure 9:
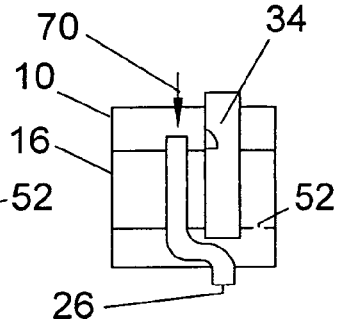
Figure 10:
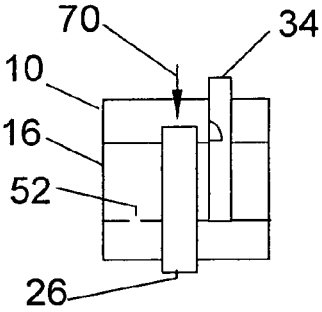
Figure 11:
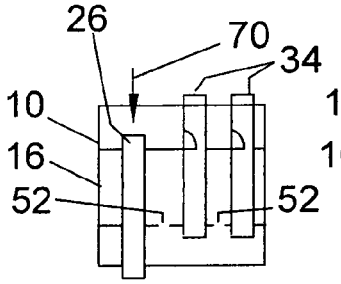
Figure 12:
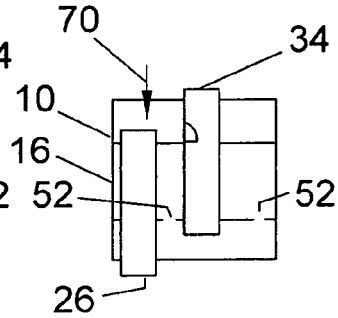
Figure 13:
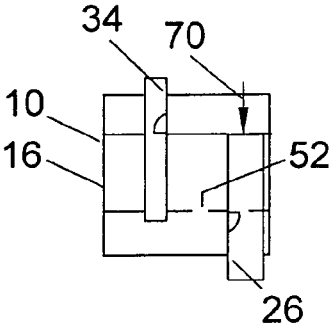

Referring to FIG. 4, the valve body 74 may be formed in the shape of a hollow truncated cone with circular cross-section side wall 80, open large end 76 and a closed small end 78 for insertion in an engagement of the side wall 80 with the open exit end 64 to plug the exit end 64 or to allow gas into the third chamber 24 to then exit through the exhaust tube 34. The small end 78 may be closed with a generally flat wall as best viewed in FIG. 4 or with a generally curved wall as best viewed in FIG. 2 depending on the sound tuning characteristics desired.

The end portion 54 of the exhaust tube 34 in the third chamber 24 and exterior of the muffler 10 may be larger in diameter than the remainder of the tube 34 or wall portion 35 in the intermediate chamber 22, see FIG. 2, to facilitate exhaust of gas from both the exhaust tube 34 and the third chamber 24. The opening 36 in the third chamber 24 may be proportionally larger than the openings 36 in the intermediate chamber 22. The opening 36 as illustrated in FIG. 2 in solid line drawing form may also be formed in the side wall of the dash line tube 34 illustrating a uniform diameter exhaust tube 34. The exhaust tube 34 may be relatively smaller in diameter than the intake tube 26. A slot 58 may be formed in the end portion 54 in instances wherein the end portion 54 is offset from the remainder of the exhaust tube 34.

Referring to FIGS. 5 through 13, while the muffler 10 has been described and illustrated with a structure having an intake tube 26, an exhaust tube 34 and a valve 70 in a particular arrangement, other position arrangements of the tubes 26, 34 in the muffler may be used with the valve 70. With one or two intake tubes 26 and one or two exhaust tubes 34, the tubes 26, 34 with valve 70 may be positioned offset from the centerline of the muffler 10 as viewed in the Figures or both tubes 26, 34 may be positioned with the tube exterior portions centered as best viewed in FIG. 9 with the intake tube 26 curved in the first chamber 20 to offset the tube intermediate portion 29 in the intermediate chamber 22. The valves 70, illustrated by an arrow symbol in the Figures, in the configurations that have two valves may have one valve 70 removed and that inlet tube 26 may be plugged at the exit end 64. The tube 26, 34 with valves 70 may be alternated in location as for example referring to FIG. 5, tubes 26 may be offset from the centerline of the muffler 10 to be adjacent the side of the cover 16 with the two exhaust tubes 34 interior to the tubes 26. Also, the tubes 26, 34 may be alternated in an order such as a first tube 26 adjacent the left side with first a tube 34 adjacent, a second tube 26 adjacent the first tube 34 and a second tube 26 adjacent the right side of the cover 16. The openings 28, 36 that are in the walls of the tubes 26, 34 in the intermediate portions 29, 35 of the tubes as illustrated in FIG. 2 as an example have not been illustrated in the schematic FIG. 5 through 13, but would be used in each tube. The arrangement of the tubes 26, 34 and the valve 70 may depend on the exhaust system of a particular vehicle and on the desired noise characteristics for the vehicle.

While relatively narrow elongated slots or openings 28, 36 have been illustrated in the Figures other shapes of openings or multiple shaped holes may be used to allow the amount of gas exit and entry to control the flow of exhausted gas and the tuning of the sound that may be selected.

The muffler 10 may be assembled by inserting the tubes 26, 34 through the various ports 40, 42, 44, 46, 48, 50, threading the shaft 72 into fitting 60, and spot welding the parts for attachment to the walls 12, 14 and the baffles 30, 32. The cover 16 may then be fitted over the edges of the end walls 12, 14 and spot welded. Use of steel as is known in the art of muffler manufacture may be used for the structure.

While the invention has been particularly shown and described with respect to the illustrated embodiments thereof, it will be understood by those skilled in the art that the foregoing and other changes in form and details may be made therein without departing from the spirit and scope of the invention.

I claim:

1. An exhaust noise control apparatus for an engine, comprising a housing having a first end wall and a second end wall spaced apart with a cover attached;

a first baffle disposed in said housing spaced apart from said first end wall to form a first interior chamber, and a second baffle disposed in said housing intermediate and spaced apart from said first baffle and said second end wall to form an intermediate chamber and a third chamber;

an intake tube inserted through an intake port in said first end wall to extend through a first baffle intake port and through a second baffle exhaust port to terminate at an exit end in said third chamber;

an exhaust tube with an exhaust output inserted through an exhaust port in said second end wall to extend through a second baffle exit port and a first baffle exit port to terminate at an inlet end in said first chamber;

said intake tube and said exhaust tube each having apertures therein disposed in a tube wall portion positioned in said intermediate chamber, and said exhaust tube having exhaust apertures formed in a second tube wall portion positioned in said third chamber;

an intermediate port formed in said first baffle;

a threaded sleeve fitting inserted through and attached to said second end wall to be disposed opposite said exit end of said intake tube; and a threaded shaft of a valve threadably engaged in said sleeve fitting to position a valve body adjacent to said exit end of said intake tube wherein said valve body is shaped to restrict gas flow out of said exit end.

2. The apparatus as in claim 1 wherein said exhaust tube is formed with a first portion with a diameter smaller than said intake tube in said intermediate chamber.

3. The apparatus as in claim 2 wherein said exhaust tube has a second portion in said third chamber and protruding through said second end wall that has a diameter larger than said first portion.

4. The apparatus as in claim 1 wherein said apertures of said intake tube and said exhaust tube are a plurality of elongated slots formed in said tube wall portion.

5. The apparatus as in claim 1 wherein said exhaust apertures of said exhaust tube positioned in said third chamber are a large slot formed in said exhaust tube wall opposed said valve.

6. The apparatus as in claim 1 wherein said valve body is shaped in the form of a truncated cone with a side wall and a hollow interior that has a large open end and a relatively smaller closed end with said threaded shaft attached interior to said valve body at said closed end.

7. The apparatus as in claim 1 wherein said threaded shaft end portion exterior to said housing has a lock nut threaded therein and a shaft head.

8. An exhaust noise control apparatus for an engine, comprising a housing having a first end wall and a second end wall spaced apart with a cover attached;

a first baffle disposed in said housing spaced apart from said first end wall to form a first interior chamber, and a second baffle disposed in said housing intermediate and spaced apart from said first baffle and said second end wall to form an intermediate chamber and a third chamber;

a first intake tube and a second intake inserted through a first intake port and a second intake port respectively in said first end wall to each extend separately through one of a plurality of a first baffle intake port and through a second baffle exhaust port to terminate at an exit end in said third chamber;

an exhaust tube with an exhaust output inserted through an exhaust port in said second end wall to extend through a second baffle exit port and a first baffle exit port to terminate at an inlet end in said first chamber;

each of said intake tubes and said exhaust tube each having apertures therein disposed in a tube wall portion positioned in said intermediate chamber, and said exhaust tube having exhaust apertures formed in a second tube wall portion positioned in said third chamber;

an intermediate port formed in said first baffle;

a threaded sleeve fitting inserted through and attached to said second end wall to be disposed opposite said exit end of said first intake tube and a plug inserted in said exit end of said second intake tube; and a threaded shaft of a valve threadably engaged in said sleeve fitting to position a valve body adjacent to said exit end of said intake tube wherein said valve body is shaped to restrict gas flow out of said exit end.

9. An exhaust noise control apparatus for an engine, comprising a housing having a first end wall and a second end wall spaced apart with a cover attached;

a first baffle disposed in said housing spaced apart from said first end wall to form a first interior chamber, and a second baffle disposed in said housing intermediate and spaced apart from said first baffle and said second end wall to form an intermediate chamber and a third chamber;

an intake tube inserted through an intake port in said first end wall to extend through a first baffle intake port and through a second baffle exhaust port to terminate at an exit end in said third chamber;

a first exhaust tube and a second exhaust tube each with an exhaust output inserted through a first exhaust port and a second exhaust port in said second end wall to extend separately through one of a plurality of a second baffle exit port and a first baffle exit port to terminate at an inlet end in said first chamber;

said intake tube and each of said exhaust tubes each having apertures therein disposed in a tube wall portion positioned in said intermediate chamber, and each of said exhaust tubes having exhaust apertures formed in a second tube wall portion positioned in said third chamber;

an intermediate port formed in said first baffle;

a threaded sleeve fitting inserted through and attached to said second end wall to be disposed opposite said exit end of said intake tube; and a threaded shaft of a valve threadably engaged in said sleeve fitting to position a valve body adjacent to said exit end of said intake tube wherein said valve body is shaped to restrict gas flow out of said exit end.

* * * * *